US006901619B1

(12) United States Patent
Hsia

(10) Patent No.: US 6,901,619 B1
(45) Date of Patent: Jun. 7, 2005

(54) DETACHABLE SWIMMING POOL MATTRESS

(76) Inventor: Ben M. Hsia, 19401 Business Center Dr., Northridge, CA (US) 91324

( * ) Notice: Subject to any disclaimer, the term of this patent is extended or adjusted under 35 U.S.C. 154(b) by 0 days.

(21) Appl. No.: 10/724,475

(22) Filed: Dec. 1, 2003

(51) Int. Cl.[7] ..... A47C 27/10; B63C 9/08

(52) U.S. Cl. ..... 5/710; 5/706; 5/722; 441/127; 441/129

(58) Field of Search ..... 5/706, 710, 722, 5/723; 441/40, 41, 44, 45, 127, 129

(56) References Cited

U.S. PATENT DOCUMENTS 2,715,231 A * 8/1955 Marston ..... 441/127
3,274,624 A * 9/1966 Noerdinger ..... 5/710
4,824,411 A * 4/1989 McClanahan ..... 441/129
5,020,175 A * 6/1991 Kirkpatrick et al. ..... 5/652
5,658,178 A * 8/1997 Varga ..... 441/1

FOREIGN PATENT DOCUMENTS

GB 2105984 A * 4/1983

* cited by examiner

*Primary Examiner*—Michael Trettel
(74) *Attorney, Agent, or Firm*—Raymond Y. Chan; David and Raymond

(57) ABSTRACT

A swimming pool mattress, for floatably supporting a user on a water surface includes a plurality of floatable mattress members, each having two engaging end portions and a mattress surface extending between the two engaging end portions, and at least two spacedly apart frame holders respectively engaging the two engaging end portions of each of the mattress members in a detachably connecting manner. Therefore, the mattress members are retained between the two frame holders to align the mattress surfaces of the mattress members to form a floating platform for supporting the user to rest thereon and to float on the water surface.

13 Claims, 8 Drawing Sheets

DETACHABLE SWIMMING POOL MATTRESS

BACKGROUND OF THE PRESENT INVENTION

1. Field of Invention

The present invention relates to mattress, and more particularly to a detachable swimming pool mattress, which allows the user to self assemble to form a floating platform in a tailor made manner for supporting the user to float on a water surface.

2. Description of Related Arts

Swimming is one of the most popular sports in the world. During holidays, especially in summer, a lot of people go to beaches or swimming pools with their friends for swimming. Very often, people don't take swimming very seriously and not treat it as a competition or serious exercise. Rather, a lot of people, especially for the children, would like to go swimming just for fun and enjoy entertainment with water. As a matter of fact, in the United States of America, a lot of people have their own swimming pool in their house for leisure.

Just because of this nature, a lot of accessories and equipments have been developed for use during swimming, especially for those basic learners, such as children, and for teenagers who treat swimming as a form of entertainment. Among them, the most notable equipments are floats and swim rings. A conventional float comprises a floating panel which is made of floatable materials, such as foam or plastic, and is cut into a predetermined shape wherein a user of the float can be able to hold on the floating panel while swimming, so that the user is assisted with floating on the water.

As a matter of fact, some more sophisticated forms of floats have been developed in order to allow the user to derive enhanced entertainment on the water. For example, giant floating beds have been developed wherein the user may simply lie on them while floating on the water. As such, while floating on water, a user may lie on the giant floating bed and do some other things such as reading, enjoying sun shine, or drinking his/her most favorite beverage.

Despite their popularities, such swimming accessories or equipments inevitably suffer some discrepancies. First of all, they are inflexible. For most of the conventional floating beds, they are only designed to function for one particular size. That means when a person, due to his/her body size, is unfit to those floating beds, he/she has no choice but to switch to other equipments, such as a swim ring. However, for those who prefer to use floating bed may be proficient in swimming, and the reason why they prefer using floating beds is that they just want to acquire some fun while floating on the water without making the effort of swimming. In relation to this, it is obvious that an adult floating bed is definitely unsuitable for a child, and for this reason, two floating beds, one for the child and one for the adult, are needed.

Second, for those floats which are not inflatable, they present storage and transportation inconvenience for their users. Very often, a non-inflatable float is in the form of a panel which is neither foldable nor reducible to any other more compact structure so that when one is going to transport it or store it, he/she has to transport or store it as such and this usually means considerable occupation of space, whether in a car, in the backyard of one's house, or even in a cupboard. Thus, a lot of people may be discouraged from using conventional floats just because they feel that they are inconvenient in terms of transportation and storage.

Finally, almost all conventional floating beds are limited to individual use. However, most people go swimming with their friends, and they may all want to use floating beds on the water so that they can, for example, chat with each other and have some fun while floating on water. The fact that each floating bed is designed to be used by a single person means that when, for example, five people go together, then five floating beds are inevitably needed. What's worse is that the five floating beds are not connected together so that while floating on water, each floating bed may float in different direction, thus jeopardizing their very purpose of going together. Even though the size of the floating bed is large enough to allow, for example, two children rested thereon, it may not have the necessary floating capability to support two peoples in a water-floatable manner. In such cases, the floating bed may present a danger to its users.

SUMMARY OF THE PRESENT INVENTION

A main object of the present invention is to provide a swimming pool mattress which comprises a plurality of floatable mattress members which is arranged to be retained by a predetermined number of frame holders to form a floating platform for supporting a person rested thereon to float on a water surface.

Another object of the present invention is to provide a swimming pool mattress wherein the floating platform is capable of being selectively expanded or reduced in size by engaging or disengaging the mattress members to and from the frame holders respectively. In other words, the size and shape of the floating platform is freely adjustable according to the user's need and preferences.

Another object of the present invention is to provide a swimming pool mattress comprising a plurality of floatable mattress members which is detachable from the frame holders so that the mattress members as well as the frame holders are adapted to be packed in a compact structure for easy transportation and storage.

Another object of the present invention is to provide a swimming pool mattress which is adapted to customarily form more than one floating platforms by the plurality of floatable mattress members, so that more than one user can rest on the floating platforms respectively. In other words, the present invention substantially overcomes the difficulty of limited user of conventional floating beds.

Another object of the present invention is to provide a swimming pool mattress comprising a plurality of floatable mattress members which are capable of being conveniently and easily connected to the frame holders. In other words, even kids can be able to build up or collapse the swimming pool mattress without needing any help of an adult.

Another object of the present invention is to provide a swimming pool mattress which does not involve complicated mechanical structure and expensive structure so that the manufacturing and marketing cost of the present invention can be minimized.

Accordingly, in order to accomplish the above objects, the present invention provides a swimming pool mattress for floatably supporting a user on a water surface, comprising:

a plurality of floatable mattress members, each having two engaging end portions and a mattress surface extending between the two engaging end portions; and at least two spacedly apart frame holders respectively engaging with the two engaging end portions of each of the mattress members in a detachably connecting manner, wherein the mattress members are retained between the two frame holders to align the mattress surfaces of the mattress members to form a floating platform for supporting the user to rest thereon to float on the water surface.

These and other objectives, features, and advantages of the present invention will become apparent from the following detailed description, the accompanying drawings, and the appended claims.

DETAILED DESCRIPTION OF THE PREFERRED EMBODIMENTS

Figure 1:
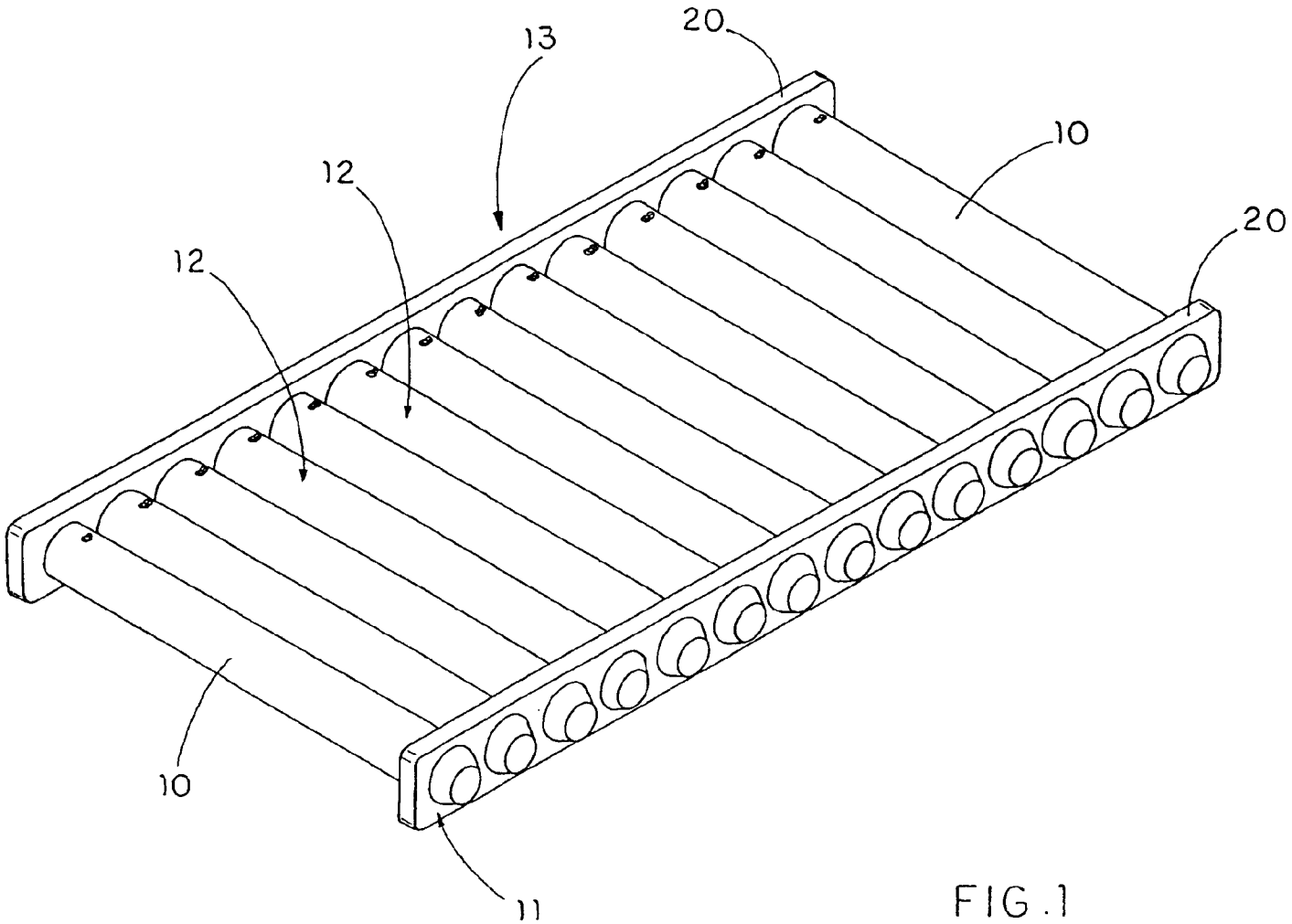
FIG. 1 is a perspective view of a detachable swimming pool mattress according to a preferred embodiment of the present invention.
Figure 2:
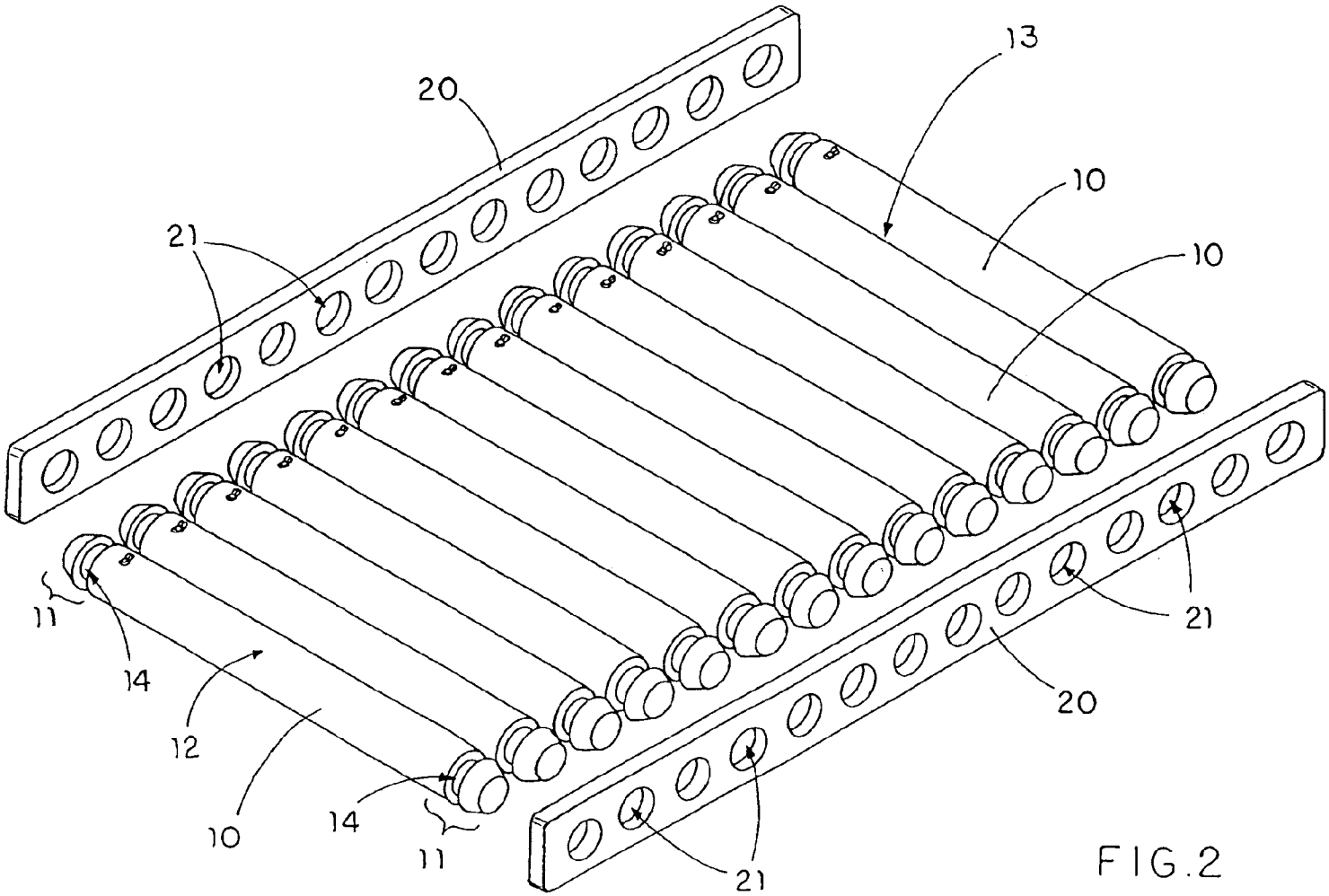
FIG. 2 is an exploded perspective view of a detachable swimming pool mattress according to the above preferred embodiment of the present invention.

Referring to FIGS. 1 to 2 of the drawings, a swimming pool mattress for floatably supporting a user on a water surface according to a preferred embodiment of the present invention is illustrated. Accordingly, the user is able to grip or rest on the swimming pool mattress of the present invention for floating on a water surface.

The swimming pool mattress comprises a plurality of floatable mattress members 10 and at least two frame holders 20. Each of the floatable mattress members 10 has two engaging end portions 11 formed thereon and an elongated supporting portion extended between the two engaging end portions 11, wherein a mattress surface 12 is longitudinally formed along the supporting portion of each of the mattress member 10 between the two engaging end portions 11 thereof.

The swimming pool mattress further comprises at least two spacedly apart frame holders 20 respectively engaging with the two engaging end portions 11 of each of the mattress members 10 in a detachably connecting manner, wherein the mattress members 10 are retained between the two frame holders 20 to align the mattress surfaces 12 of the mattress members 10 to form a floating platform 13 for supporting the user to rest thereon to float on the water surface.

According to the preferred embodiment, the mattress members 10 is made of low-density or water foldable materials having a predetermined buoyancy, such as foam material or polyvinyl chloride (PVC) rubber, so that each of the mattress members 10 is capable of supporting the user on its respective mattress surface 12 while floating on the water surface. Moreover, each of the mattress members 10 can have a cross sectional shape of a circle, square, rectangle, and indeed any other shape. According to the preferred embodiment, each of the mattress members 10 is embodied as having a circular cross sectional shape.

Figure 3:
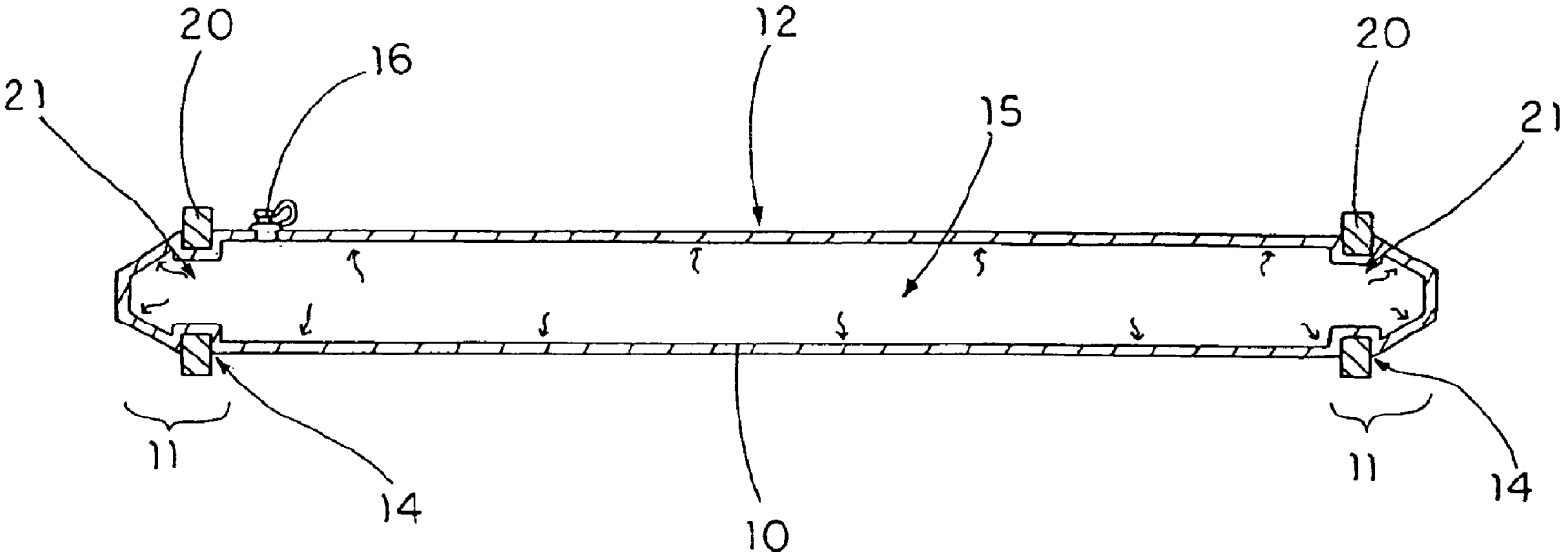
FIG. 3 is a sectional view of the detachable swimming pool mattress according to the above preferred embodiment of the present invention.

As shown in FIG. 3, each of the mattress members 10, which is embodied as an inflatable member, has an air chamber 15 and an air valve 16 communicating with the air chamber 15 for retaining a predetermined amount of air therewithin, in such a manner that each of the mattress members 10 is adapted to be inflated through the air valve 16 to retain the mattress surface 12 of the mattress member 10 between the two engaging end portions 11 thereof, and to be deflated for releasing the air within the air chamber 15.

In other words, the mattress members 10 are made to be air-inflatable which is adapted for floating on a water surface. Thus, the mattress members 10 can be made of elastic yet strong materials such as plastic so that when fully inflated, it is capable of supporting the user on its mattress surface 12 floating on a water surface while the mattress surfaces 12 of the mattress members 10 are lined up to form the floating platform 13.

Each of the frame holders 20 is made of floatable material such as foaming material so as to enhance the floating ability of the floating platform 13 of the detachable swimming pool mattress of the present invention.

As shown in FIG. 2, each of the frame holders 20 has a plurality of engaging slots 21 alignedly formed therealong wherein the engaging end portions 11 of the mattress members 10 are detachably inserted into the engaging slots 21 respectively such that the mattress surfaces 12 of the mattress members 10 are aligned to form the floating platform 13. Moreover, the cross sectional shape of each of the engaging slots 21 is corresponding to the cross sectional shape of the respective engaging end portion 11, so that the engaging end portion 11 of each of the mattress members 10 is fittingly engaged with the respective engaging slot 21.

Accordingly, each of the engaging slots 21 is a through slot transversely aligned through the respective frame holder 20 wherein the engaging end portion 11 of the mattress member 10 is slidably passed through the respective engaging slot 21 so as to mount the mattress member 10 to the frame holder 20.

In other words, the mattress members 10 are substantially retained between the two frame holders 20 to align the mattress surfaces 12 with each other to form the floating platform 13 for supporting a user resting thereon while floating on a water surface, as shown in FIG. 1.

Referring to FIG. 2 of the drawings, each of the mattress members 10 has two retaining grooves 14 transversely formed around the two engaging end portions 11 of the mattress member 10 respectively to securely retain the engaging end portion 11 of the mattress member 10 with the respective engaging slot 21.

Accordingly, each of the retaining grooves 14 is indently formed at the respective engaging end portion 11 of the mattress member 10 wherein each of the engaging slots 21 is shaped and sized to fittingly hold the respective engaging end portion 11 of the mattress member 10. In other words, each of the engaging slots 21 has a size slightly larger than a size the retaining groove 14 in such a manner that when the engaging end portion 11 of the mattress member 10 is slidably inserted into the engaging slot 21, an inner wall of the engaging slot 21 substantially biases against an outer wall of the retaining groove 14 so as to substantially hold the engaging end portion 11 of the mattress member 10 within the engaging slot 21, as shown in FIG. 3.

Therefore, the mattress members 10 are engaged with the frame holders 20 by slightly squeezing the engaging end portions 11 of the mattress members 10 to slidably insert into the engaging slots 21 respectively until the retaining grooves 14 are substantially aligned with the engaging slots 21 respectively. Then, once the squeezing force is relieved, the two engaging end portions 11 are, by their elastic nature, recovered to their original size and shape in such a manner that the engaging slot 21 substantially surrounds the respective engaging end portion 11 of the mattress member 10 at the retaining groove 14 thereof so as to securely mount the mattress member 10 with the frame holder 20.

As shown in FIG. 3, each of the mattress members 10 further has two tapered end 101 having a size gradually reducing from the engaging end portion 11, wherein the tapered end 101 of each of the mattress members 10 has a size substantially smaller than a size of the engaging slot 21 so as to enhance the engaging end portion 11 of the mattress member 10 to slidably insert into the engaging slot 21 of the frame holder 20.

It is worth to mention that the user can be able to self assemble the detachable swimming pool mattress of the present invention by slidably inserting the engaging end portions 11 of the mattress members 10 into the engaging slots 21 of the frame holders 20 respectively to form the floating platform 13 without any foreseeable difficulty. Thus, the swimming pool mattress can be disassembled for storage or transportation by slidably detaching the engaging end portions 11 of the mattress members 10 from the engaging slots 21 of the frame holders 20. Therefore, the assembly and disassembly operation of the detachable swimming pool mattress is quick and simple that even a small kid or a teenager is able to complete the operation without necessarily needing the help of an adult.

Figure 4A:
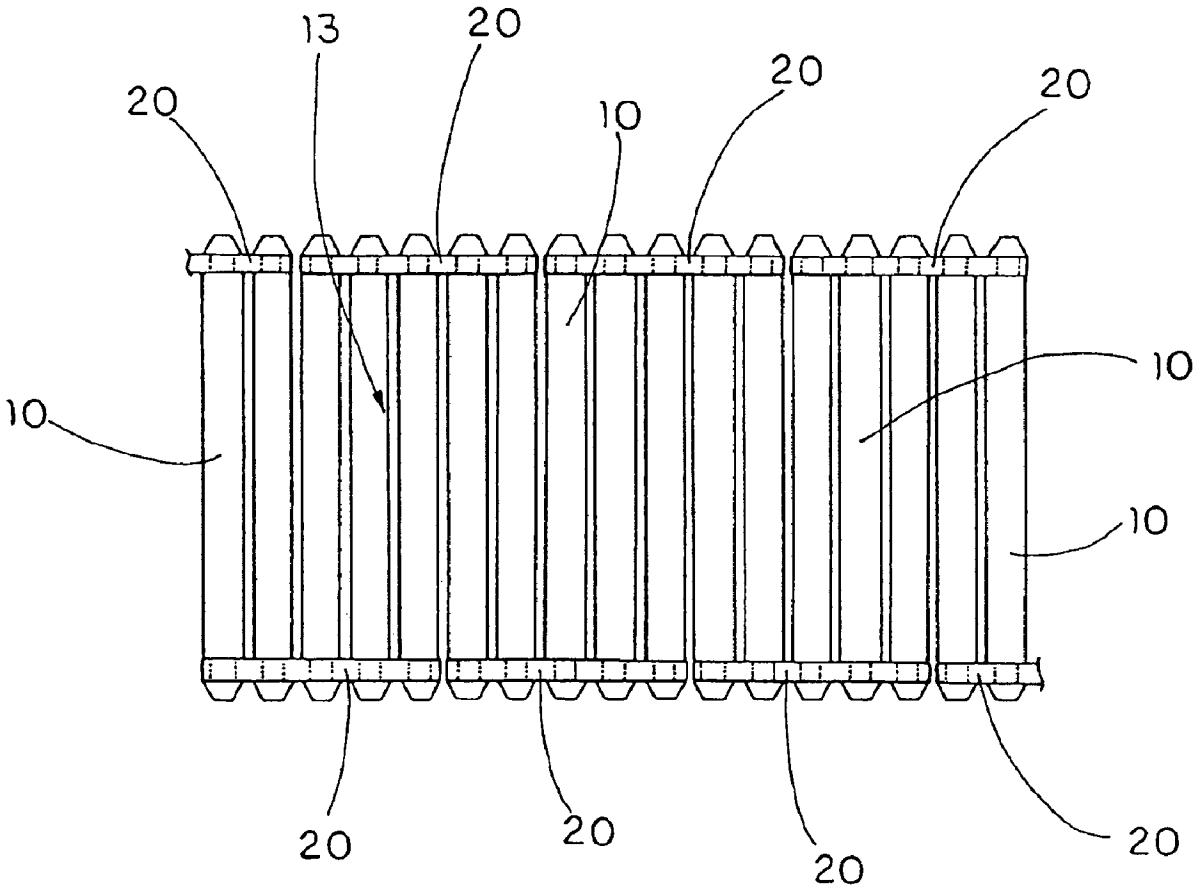
FIGS. 4A to 4B are schematic diagrams of the detachable swimming pool mattress according to the above preferred embodiment of the present invention, illustrating that the floating platforms are capable of varying sizes and shapes.
Figure 4B:
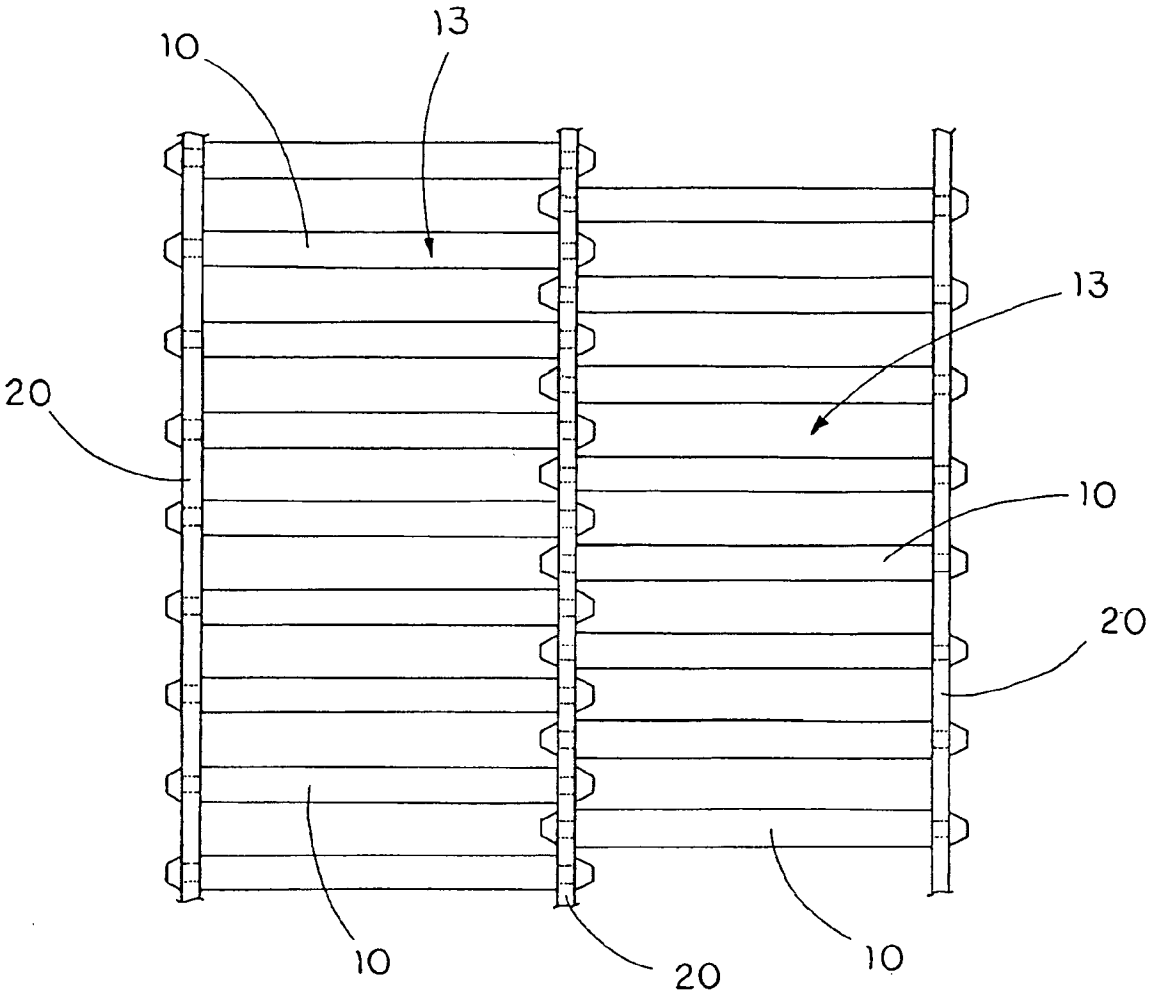

Referring to FIG. 4A to FIG. 4B of the drawings, the swimming pool mattress is capable of forming different shapes and sizes so as to fit different needs of different user(s). For example, referring to FIG. 4A of the drawings, a plurality of frame holders 20 may be utilized for engaging the mattress members 10 into a wide variety of structures as the user(s) decide(s). Then, the swimming pool mattress is capable of being utilized by more than one user, thus substantially overcoming the inherent single user limitation of conventional floating beds. Moreover, the numbers of mattress members 10 used may be dictated by the user so that in accordance with his/her body size, the user is able to utilize an optimal number of mattress members 10 to form an optimal size of the floating platform 13. Alternatively, as shown in FIG. 4B of the drawings, the swimming pool mattress can be expanded to form two or more floating platforms 13 for supporting two or more users floating on a water surface.

Figure 5:
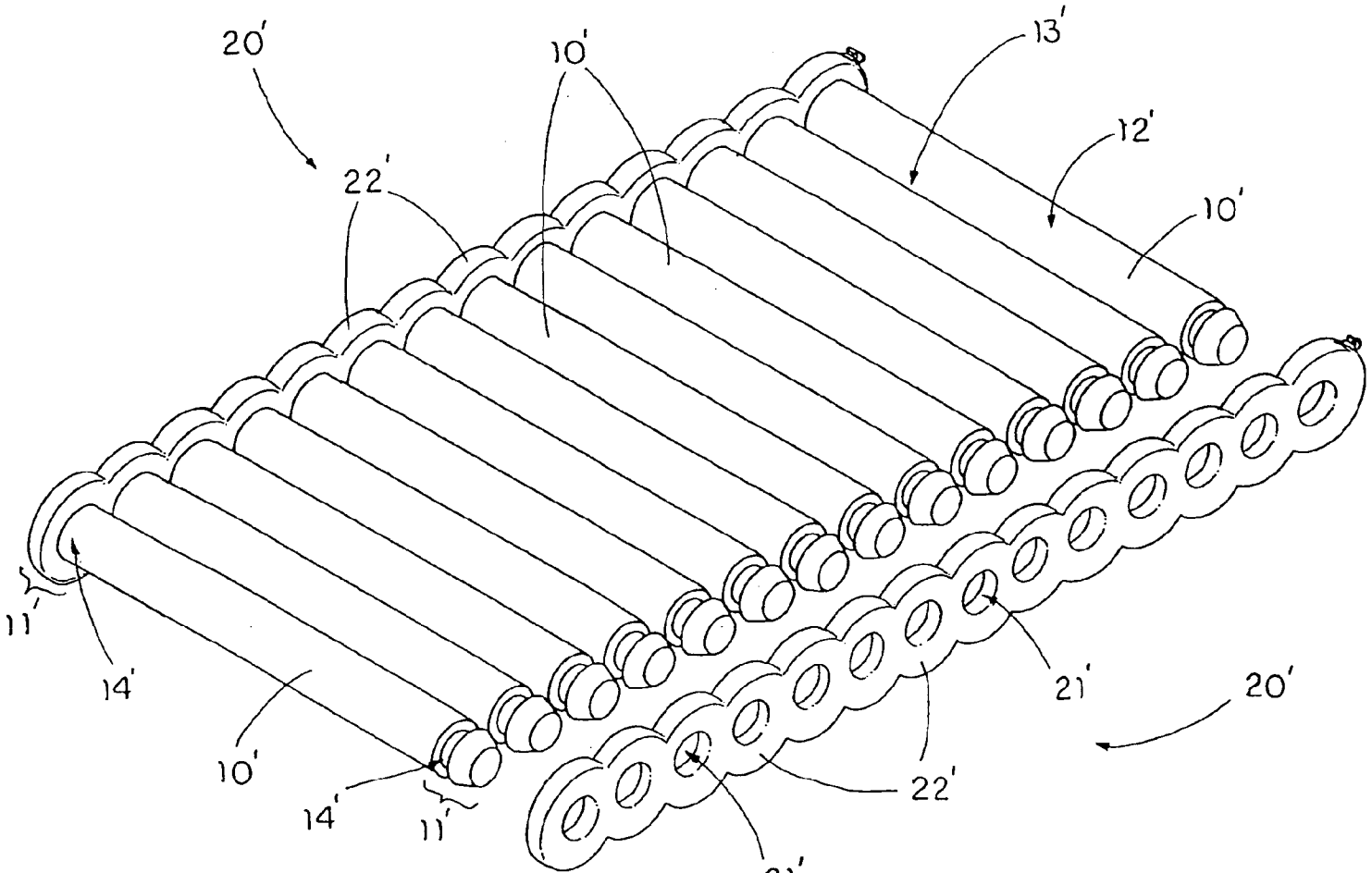
FIG. 5 is a first alternative mode of the detachable swimming pool mattress according to the above preferred embodiment of the present invention.

FIG. 5 illustrates a first alternative mode of the swimming pool mattress in which each of the frame holders 20' comprises a plurality of mattress binders 22' integrally connected with each other wherein each of the mattress binders 22' has the engaging slots 21' formed thereon to detachably engage with the engaging end portions 11' of the mattress members 10' in a detachable connecting manner to form the floating platform 13' as mentioned above. The exterior shape of each of the mattress binders 22' can be circular, rectangular, square, or any other shapes, depending on the circumstances in which the swimming pool mattress' is utilized. For example, fancy shapes, such as a duck-like shape or a fish-like, may be embodied for decoration or promotion purposes.

Figure 6:
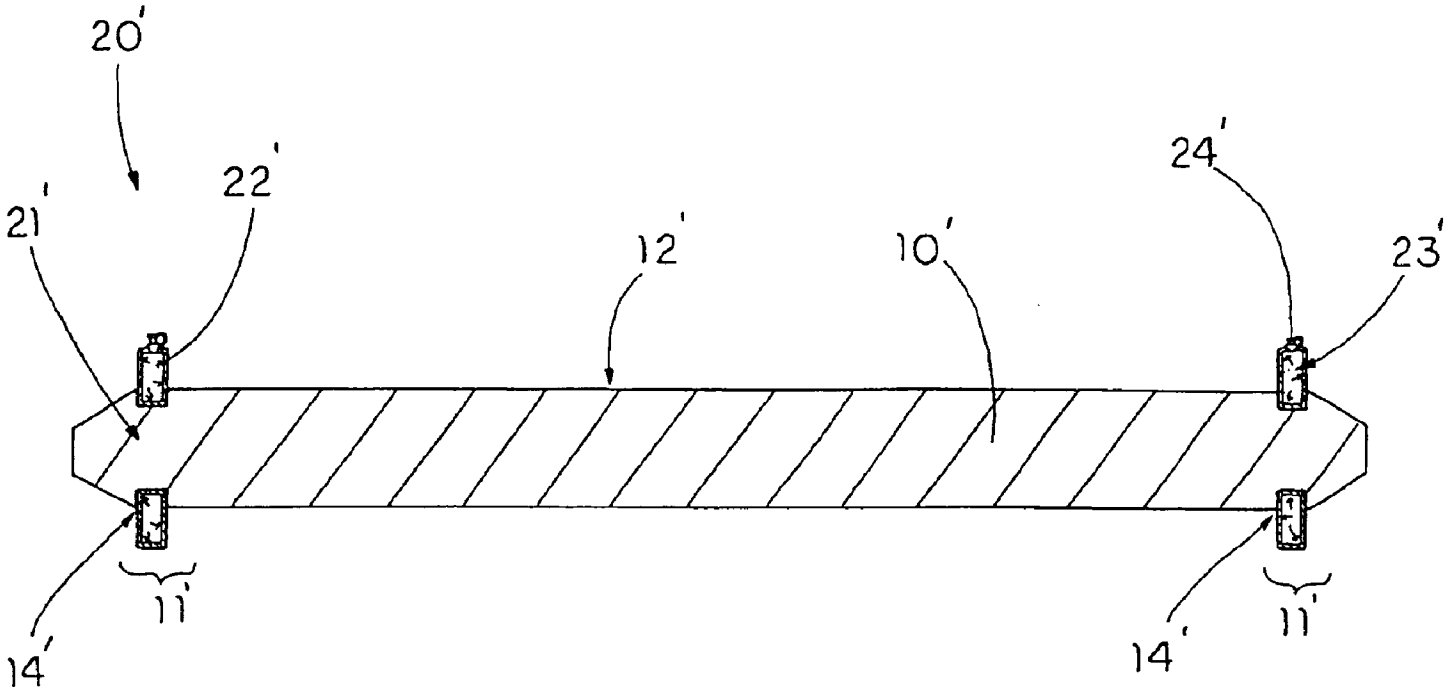
FIG. 6 is a sectional view of the detachable swimming pool mattress of the first alternative mode according to the above preferred embodiment of the present invention.

Accordingly, each of the frame holders 20', which is embodied as an inflatable member, has an air cavity 23' and an air regulator 24' communicating with the air cavity 23' for retaining a predetermined amount of air therewithin, in such a manner that each of the frame holders 20' is adapted to be inflated through the air regulator 24' to form the engaging slots 21', and to be deflated for releasing the air within the air cavity 23', as shown in FIG. 6. Accordingly, the mattress binders 22' are communicated with each other through the air cavity 23' such that during the inflation, the mattress binders 22' are inflated at the same time to form the engaging slots 21' respectively.

Each of the mattress members 10' is made of floatable material such as foaming material to enhance the floating ability of the detachable swimming pool mattress of the present invention. In addition, each of the mattress members 10' has two retaining grooves 14' transversely formed around the two engaging end portions 11' of the mattress member 10' respectively to securely retain the engaging end portion 11' of the mattress member 10' with the respective engaging slot 21'.

Therefore, when the engaging end portions 11' of the mattress members 10' are respectively inserted into the engaging slots 21', the mattress binders 22' binds the engaging end portions 11' of the mattress members 10' to align the mattress surfaces 12' thereof to form the floating platform 13'.

As shown in FIG. 6, each of the mattress members 10' further has two tapered end 101' having a size gradually reducing from the engaging end portion 11', wherein the tapered end 101' of each of the mattress members 10' has a size substantially smaller than a size of the engaging slot 21' so as to enhance the engaging end portion 11' of the mattress member 10' to slidably insert into the engaging slot 21' of the frame holder 20'.

It is obvious that the mattress members 10, 10' and the frame holders 20, 20', according to the preferred embodiment and its alternative, are interchangeable that both the mattress member 10 and the frame holder 20' can be made by inflatable structure and both the mattress member 10' and the frame holder 20 can be made of foaming material.

Figure 7:
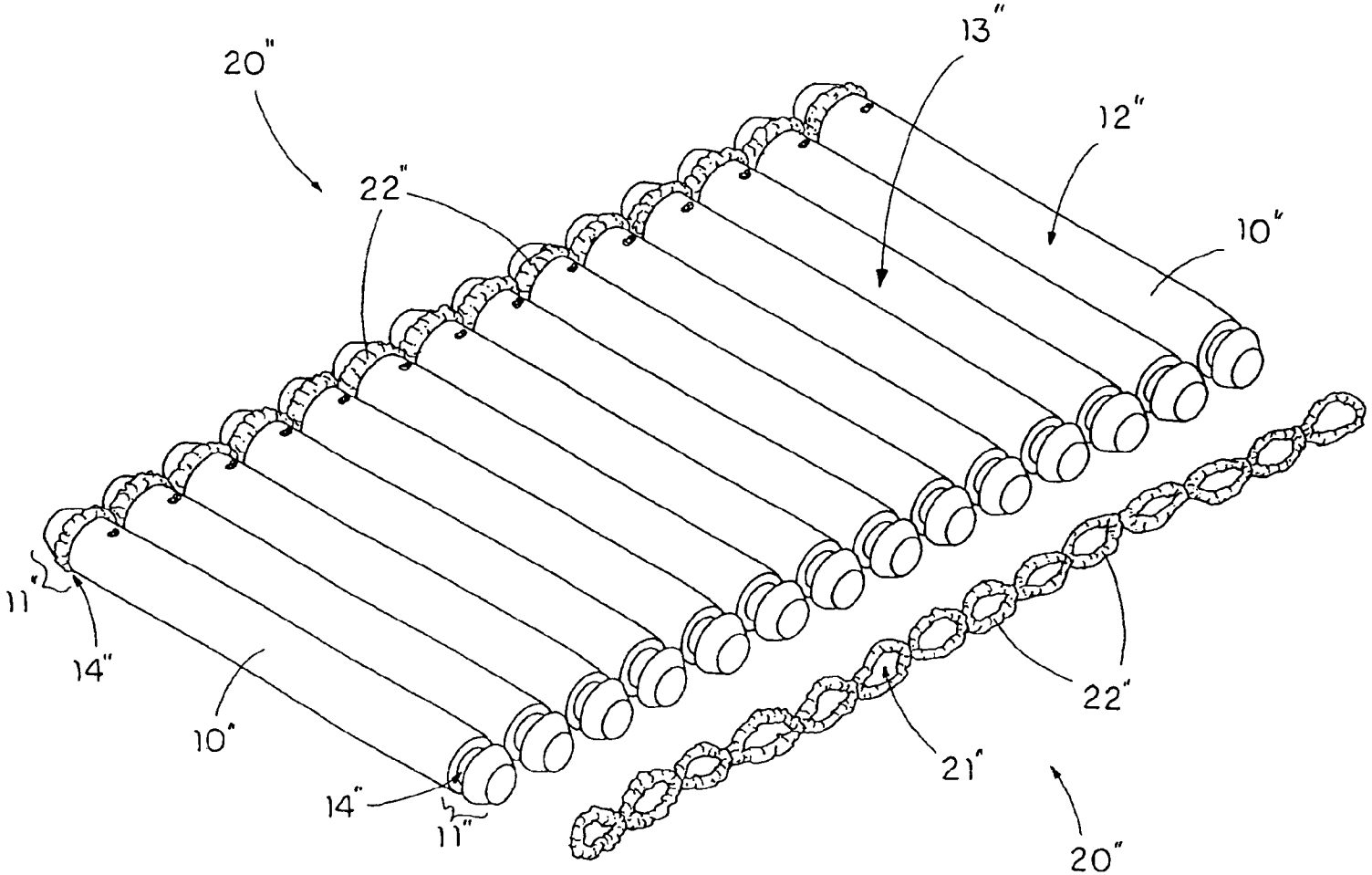
FIG. 7 is a second alternative mode of the detachable swimming pool mattress according to the above preferred embodiment of the present invention.

FIG. 7 illustrates another alternative mode of the frame holder 20" which comprises a plurality of elastic binders 22" coupling with each other. Each of the elastic binders 22', having an engaging slot 21", is adapted for applying an elastic binding force on the engaging end portion 11" of the respective mattress member 10" in such a manner that when the engaging end portions 11" of the mattress members 10" are respectively inserted into the engaging slots 21", the elastic binders 22" binds the engaging end portions 11" of the mattress members 10" to align the mattress surfaces 12" thereof to form the floating platform 13".

Accordingly, each of the mattress members 10" has two retaining grooves 14" transversely formed around the two engaging end portions 11" of the mattress member 10" respectively such that the elastic binders 22" substantially bind up the engaging end portions 11" of the mattress members 10" at the retaining grooves 14" respectively to securely retain the engaging end portion 11" of the mattress member 10" with the respective engaging slot 21".

It is worth to mention that each of the mattress members 10" can be embodied as the mattress member 10 having an inflatable structure as shown in FIG. 3, or as the mattress member 10' made of foaming material as shown in FIG. 6. In addition, since the elastic binders 22" bind up the mattress member 10" with the elastic binding force, each of the mattress members 10" may form an irregular shape and is capable of being collapsed to a compact structure so as to minimize the space occupied by the swimming pool mattress for storage or transportation purposes.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A detachable swimming pool mattress for floatably supporting a user on a water surface, comprising:

a plurality of floatable mattress members, each having two engaging end portions and a mattress surface extending between said two engaging end portions; and at least two spacedly apart frame holders respectively engaging with said two engaging end portions of each of said mattress members in a detachably connecting manner, wherein said mattress members are retained between said two frame holders to align said mattress surfaces of said mattress members to form a floating platform for supporting said user to rest thereon and to float on said water surface, wherein each of said frame holders has a plurality of engaging slots alignedly formed therealong, wherein each of said engaging slots is shaped and sized corresponding to said engaging end portion of said mattress member such that when said engaging end portions of said mattress members are detachably inserted into said engaging slots respectively, said mattress surfaces of said mattress members are aligned to form said floating platform, wherein each of said mattress members further has two tapered ends each having a size gradually reducing form said engaging end portion, wherein said tapered end of each of said mattress members has a size substantially smaller than a size of said engaging slot so as to enhance said engaging end portion of said mattress member to slidably insert into said engaging slot of said frame holder.

2. The detachable swimming pool mattress, as recited in claim 1, wherein each of said mattress members has two retaining grooves transversely formed around said two engaging portions respectively such that when said engaging end portions of said mattress members are respectively inserted into said engaging slots, an inner wall of said engaging slot substantially biases against an outer wall of said retaining groove so as to substantially hold said engaging end portion of said mattress member within said engaging slot.

3. The detachable swimming pool mattress, as recited in claim 2, wherein each of said mattress members has an air chamber and an air valve communicating with said air chamber for retaining a predetermined amount of air therewithin, in such a manner that each of said mattress members is adapted to be inflated through said air valve to retain said mattress surface of said mattress member between said two engaging end portions thereof, and to be deflated for releasing said air within said air chamber.

4. The detachable swimming pool mattress, as recited in claim 3, wherein each of said frame holders has an air cavity and an air regulator communicating with said air cavity for retaining a predetermined amount of air therewithin, in such a manner that each of said frame holders is adapted to be inflated through said air regulator to form said engaging slots, and to be deflated for releasing said air within said air cavity.

5. The detachable swimming pool mattress, as recited in claim 3, wherein each of said frame holders is made of foaming material to enhance a floating ability of said floating platform.

6. The detachable swimming pool mattress, as recited in claim 2, wherein each of said mattress members is made of foaming material to enhance a floating ability of said floating platform.

7. The detachable swimming pool mattress, as recited in claim 6, wherein each of said frame holders is made of foaming material to enhance a floating ability of said floating platform.

8. A detachable swimming pool mattress for floatably supporting a user on a water surface, comprising:

a plurality of floatable mattress members, each having two engaging end portions and a mattress surface extending between said two engaging end portions; and at least two spacedly apart frame holders respectively engaging with said two engaging end portions of each of said mattress members in a detachably connecting manner, wherein said mattress members are retained between said two frame holders to align said mattress surfaces of said mattress members to form a floating platform for supporting said user to rest thereon and to float on said water surface, wherein each of said frame holders has a plurality of engaging slots alignedly formed therealong, wherein each of said engaging slots is shaped and sized corresponding to said engaging end portion of said mattress member such that when said engaging end portions of said mattress members are detachably inserted into said engaging slots respectively, said mattress surfaces of said mattress members are aligned to form said floating platform, wherein each of said mattress members has two retaining grooves transversely formed around said two engaging portions respectively such that when said engaging end portions of said mattress members are respectively inserted into said engaging slots, an inner wall of said engaging slot substantially biases against an outer wall of said retaining groove so as to substantially hold said engaging end portion of said mattress member within said engaging slot, wherein each of said mattress members has an air chamber and an air valve communicating with said air chamber for retaining a predetermined amount of air therewithin, in such a manner that each of said mattress members is adapted to be inflated through said air valve to retain said mattress surface of said mattress member between said two engaging end portions thereof, and to be deflated for releasing said air within said air chamber, wherein each of said frame holders has an air cavity and an air regulator communicating with said air cavity for retaining a predetermined amount of air therewithin, in such a manner that each of said frame holders is adapted to be inflated through said air regulator to form said engaging slots, and to be deflated for releasing said air within said air cavity.

9. A detachable swimming pool mattress for floatably supporting a user on a water surface, comprising:

a plurality of floatable mattress members, each having two engaging end portions and a mattress surface extending between said two engaging end portions, wherein each of said mattress members is made of foaming material to enhance a floating ability of said floating platform; and at least two spacedly apart frame holders respectively engaging with said two engaging end portions of each of said mattress members in a detachably connecting manner, wherein said mattress members are retained between said two frame holders to align said mattress surfaces of said mattress members to form a floating platform for supporting said user to rest thereon and to float on said water surface, wherein each of said frame holders is made of foaming material to enhance a floating ability of said floating platform.

10. The detachable swimming pool mattress, as recited in claim 9, wherein each of said frame holders comprises a plurality of elastic binders coupling with each other and defining said engaging slots therewithin respectively, wherein each of said elastic binders is adapted for applying an elastic binding force on said engaging end portion of said respective mattress member in such a manner that when said engaging end portions of said mattress members are respectively inserted into said engaging slots, said elastic binders binds said engaging end portions of said mattress members to align said mattress surfaces thereof to form said floating platform.

11. The detachable swimming pool mattress, as recited in claim 10, wherein each of said mattress members has two retaining grooves transversely formed around said two engaging end portions of said mattress member respectively such that said elastic binders substantially bind up said engaging end portions of said mattress members at said retaining grooves respectively to securely retain said engaging end portion of said mattress member with said respective engaging slot.

12. The detachable swimming pool mattress, as recited in claim 11, wherein each of said mattress members has an air chamber and an air valve communicating with said air chamber for retaining a predetermined amount of air therewithin, in such a manner that each of said mattress members is adapted to be inflated through said air valve to retain said mattress surface of said mattress member between said two engaging end portions thereof, and to be deflated for releasing said air within said air chamber.

13. The detachable swimming pool mattress, as recited in claim 11, wherein each of said mattress members is made of foaming material to enhance a floating ability of said floating platform.

* * * * *